United States Patent [19]

Kato et al.

[11] Patent Number: 4,485,643

[45] Date of Patent: Dec. 4, 1984

[54] EVAPORATOR FOR REFRIGERATORS AND THE LIKE

[75] Inventors: Shuichiro Kato, Kawanishi; Yoshinori Yabu, Tenri; Yoshihiro Kinoshita, Osaka, all of Japan

[73] Assignees: The Nippon Aluminium Mfg. Co. Ltd., Osaka; Kabushiki Kaisha Toshiba; Kakinuma Kinzoku Seiki Co. Ltd., both of Tokyo, all of Japan

[21] Appl. No.: 406,975

[22] Filed: Aug. 9, 1982

[30] Foreign Application Priority Data

Aug. 24, 1981 [JP] Japan ..... 56-133172

[51] Int. Cl.[3] ..... F25B 39/02

[52] U.S. Cl. ..... 62/519; 62/525; 165/175

[58] Field of Search ..... 62/519, 520, 341, 524, 62/525; 165/175, 168

[56] References Cited

U.S. PATENT DOCUMENTS

| | | | |
|---|---|---|---|
| 1,796,945 | 10/1928 | Harter | 165/175 |
| 1,903,351 | 4/1933 | Lipman | 62/519 |
| 2,381,686 | 2/1944 | Peltier | 62/520 |
| 2,619,811 | 12/1952 | Philipp | 62/519 |
| 3,203,199 | 8/1965 | Stewart | 62/519 |

*Primary Examiner*—William E. Wayner
*Assistant Examiner*—John Sollecito
*Attorney, Agent, or Firm*—Browdy and Neimark

[57] ABSTRACT

An evaporator for refrigerators and the like, comprising a sheet and at least one refrigerant flow passage assembly which includes a multi-passage unit having a plurality of parallel flow passages, an inlet header pipe connected to the inlet openings of the flow passages and an outlet header pipe connected to the outlet openings of the flow passages. The sheet which carries on one surface thereof the passage assembly or assemblies is bent to form a rectangular box-like structure of a cooler for a freezing chamber formed in the refrigerators.

9 Claims, 17 Drawing Figures

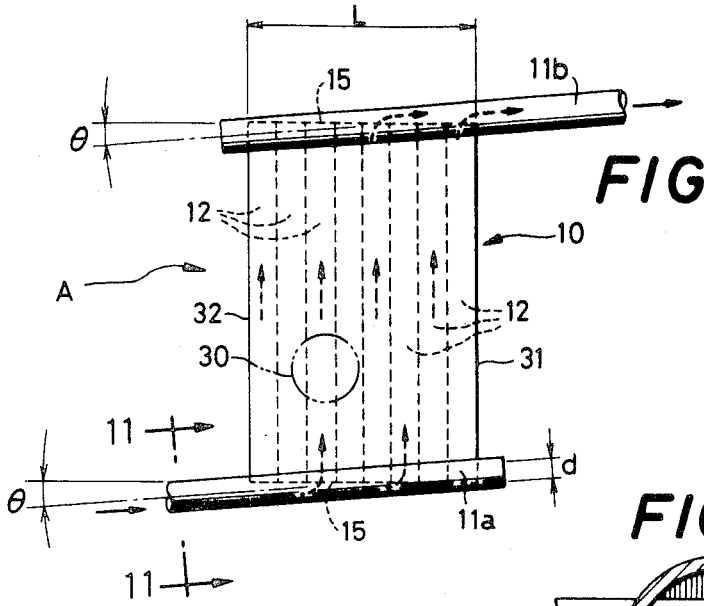
FIG. 10A
FIG. 11
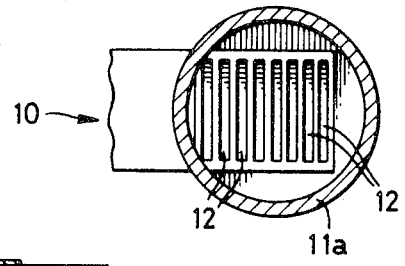
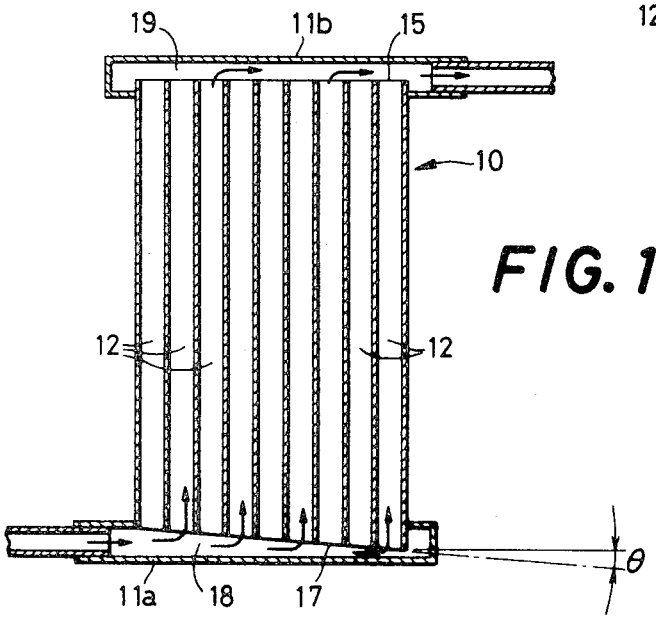
FIG. 10B

EVAPORATOR FOR REFRIGERATORS AND THE LIKE

BACKGROUND OF THE INVENTION

1. Field of the Invention

This invention relates generally to an evaporator for use with a refrigerator and the like, and more particularly to an evaporator for the freezing chamber of a refrigerator, freezing refrigerator or similar apparatus wherein a part of the cooler is provided with a very low temperature portion.

2. Description of the Prior Art

In the art of manufacture of such type of evaporators, there have been mainly employed two different sorts of techniques, i.e., a pipe-on-sheet method and a roll-bond method. An example of an evaporator of the type manufactured with the pipe-on-sheet method is shown in U.S. Pat. No. 4,227,379, the disclosure of which is hereby incorporated by reference. This type of evaporator comprises a refrigerant passage pipe or evaporator coil which extends in a meandering fashion and is fixed, with an adhesive or by other means, to one surface of a sheet of aluminum or other materials. This sheet with the pipe fixed thereto is bent to form a wall or walls to define a freezing chamber of rectangular cross section. The pipe has a passage through which refrigerant flows in gas and liquid phases. However, the evaporator with such construction having a very small number of, usually one or two, pipes designed as refrigerant passageway means, is disadvantageous when a large magnitude of thermal load is applied to a limited portion of the pipe. More specifically, when foodstuff articles of room or normal temperature are placed on an area covering a limited part of the pipe, the portion of the refrigerant within said limited part of the pipe changes from a liquid to a vapor at a very high rate whereby the refrigerant becomes unable to afford to flow, or in more detail, a majority portion of the refrigerant in a portion of the pipe on the outlet side is forced by a pressure of vaporous refrigerant developed in said limited part and thus forcibly discharged out of the pipe while remaining in liquid phase (i.e., while maintaining its cooling energy). This phenomenon will cause to decrease the cooling efficiency of the cooling system as a whole. There is recognized another disadvantage of the evaporator having the above construction that such forced discharge of liquid refrigerant out of the pipe and the resultant flowing of the liquid refrigerant into the suction pipe of a compressor will necessitate the provision of an accumulator at a point within the length of the suction pipe in order to prevent the entry of liquid refrigerant into the compressor. This requirement will complicate the construction of the refrigerating system as a whole and thereby increase the manufacturing cost thereof. A further disadvantage of the pipe-on-sheet type of evaporator wherein the refrigerant passageway means is constituted by one or two pipes, is that the flow resistance of the entire passageway means tends to be high and accordingly the required power consumption by the compressor is increased. The evaporator has a still further disadvantage in the manufacturing process. To be more specific, modifications of a path pattern of the pipe (path along which the pipe extends) require changes in dimensions of the pipe used. In other words, to provide a variety of evaporators of different path patterns of a pipe or pipes, the corresponding kinds of pipes must be prepared thereby creating the need of cumbersome control of pipe stock, complicating the process for assembling the evaporators, and consequently pushing up the overall manufacturing cost.

On the other hand, the so-called "roll-bond" evaporators are manufactured by roll-welding, for example, two superposed aluminum sheets with a tube between them and then expanding or inflating the compressed tube by applying a fluid pressure so as to form a refrigerant passage between the welded sheets. Due to the nature of such process, this passage can not have a sufficiently large cross section and is therefore limited in volume. This volume limitation causes shortcomings such as a low cooling efficiency and a high flow resistance of the evaporator, and those shortcomings lead to a large power consumption by the compressor in the system.

SUMMARY OF THE INVENTION

Accordingly, it is an object of the present invention to provide an evaporator having refrigerant passage means of low overall flow resistance and capable of efficient evaporation of the refrigerant within the passage means.

Another object of the invention is to provide a cooler of a refrigerator or the like which has an extremely improved cooling efficiency.

A further object of the invention is to provide an evaporator which prevents or restricts a discharge of the refrigerant therefrom while remaining in the liquid state, and which allows a simple and compact construction of the cooling system as a whole in which the evaporator is incorporated.

Other objects of this invention will become apparent to those skilled in the art from the following detailed description of the preferred embodiments when read in connection with the accompanying drawings.

To attain these objects, an evaporator constructed according to the invention comprises: (a) at least one multi-passage unit of plate-like configuration constructed of a thermally conductive material and having a predetermined thickness, the multi-passage unit having portions to define a plurality of refrigerant flow passages in parallel relation with one another, the flow passages being open at opposite ends of the multi-passage unit; (b) inlet header means for distributing refrigerant into the plurality of refrigerant flow passages, the inlet header means being connected to one of the opposite ends of the multi-passage unit and having a refrigerant supply passage through which the refrigerant is supplied and to which the flow passages are open at said one end; and (c) outlet header means for collecting and discharging the refrigerant flowing out of the flow passages, the outlet header means being connected to the other end of the multi-passage unit and having a refrigerant discharge passage through which the refrigerant is discharged and to which the flow passages are open at said other end.

In general, the multi-passage unit is fixed to a sheet member of a thermally conductive material such that one surface of the unit is in abutment on one surface of the sheet member with substantially no air gap therebetween, whereby the multi-passage unit is used as an efficient cooler element. The multi-passage unit which is thus mounted on a sheet member is usually provided in plural numbers in series connection with one another. In a preferred form of the present evaporator, these plural multi-passage units are disposed such that the refrigerant flow passages formed in one of the units are parallel to those formed in all of the other units, and the inlet and outlet header means for the units are connected such that the refrigerant flows through the flow passages in alternately opposite directions from one of the units connected in series to the next, or such that the refrigerant flows in the same direction through the passages formed in all of the units.

According to one preferable feature of the invention, the inlet header means is connected to the multi-passage unit such that the line of open ends of the plurality of refrigerant flow passages is inclined with respect to the line of flow of the refrigerant through said refrigerant supply passage formed in the inlet header means, so that the open ends located downstream of the refrigerant flow extend a more distance across the refrigerant flow than those located upstream of the flow. In other words, the inlet header means has a cutout axially formed through the wall thereof to communicate with the refrigerant supply passage, and the one end of the multi-passage unit fixedly engages the cutout so that a distance of radial extension thereof into the supply passage increases in the direction of flow of the refrigerant therethrough. With the above construction, a flow of refrigerant supplied through the supply passage within the inlet header means is introduced into each of the flow passages via the respective open end so that the amount of the refrigerant flow into each flow passage of the unit is equalized or an equal amount of refrigerant is supplied to all of the flow passages.

It is possible and appreciated that the similar construction applies to the outlet header means and the outlet end of the multi-passage unit so that an equal amount of refrigerant is discharged from all of the flow passages of the unit. In such construction, the outlet header means has a cutout axially formed through the wall thereof to communicate with the refrigerant discharge passage, and the other end of the multi-passage unit fixedly engages the cutout in such a manner that a distance of radial extension thereof into the refrigerant discharge passage decreases in the direction of flow of the refrigerant therethrough.

It is appreciated that the multi-passage unit is prepared by extruding a billet or slab of aluminum or aluminum alloy materials using a desired hollow die so that the obtained extrusion has hollow formations to define the plurality of refrigerant flow passages.

According to another embodiment of the invention, there is provided a cooler having a freezing chamber. The cooler comprises: (a) a sheet member constructed of a thermally conductive material and forming a cooler body preferably having a substantially rectangular box structure defining the freezing chamber; (b) at least one multi-passage unit of plate-like configuration constructed of a thermally conductive material and having a predetermined thickness, the multi-passage unit being fixed to the sheet member with one surface thereof being in abutment upon the outer surface of the sheet member, the multi-passage unit including portions to define a plurality of refrigerant flow passages in parallel relation with one another, the flow passages being open at opposite ends of the multi-passage unit; (c) inlet header means for distributing refrigerant into the plurality of refrigerant flow passages, the inlet header means being connected to one of the opposite ends of the multi-passage unit and having a refrigerant supply passage through which the refrigerant is supplied and to which the flow passages are open at said one end; and (d) outlet header means for collecting and discharging the refrigerant flowing out of the flow passages, the outlet header means being connected to the other end of the multi-passage unit and having a refrigerant discharge passage through which the refrigerant is discharged and to which the flow passages are open at said other end.

It is preferred in such cooler that the sheet member is bent to form the rectangular box structure whose at least two wall portions each carry on the outer surface at least one combination of the multi-passage unit and the inlet and outlet header means.

According to one preferred embodiment of the cooler of the invention, at least one of the side, top and bottom wall portions of the rectangular box structure carries on the outer surface thereof at least one refrigerant flow passage assembly consisting of the multi-passage unit and the inlet and outlet header means, the multi-passage unit of the flow passage assembly carried on the at least one wall portion of the structure being not extending on the outer surface of the other wall portions, the at least one flow passage assembly being connected in series to other flow passage assemblies carried on the other wall portions of the box structure.

According to another preferred embodiment of the cooler, at least one of the side wall portions of the rectangular box structure carries on the outer surface thereof at least one refrigerant flow passage assembly consisting of the multi-passage unit and the inlet and outlet header means, the at least one flow passage assembly being disposed such that the plurality of refrigerant flow passages in the multi-passage unit extend in substantially horizontal direction.

BRIEF DESCRIPTION OF THE DRAWINGS

This invention will be better understood from the following description taken in connection with the accompanying drawings, in which:

FIG. 10A is a plan view of the multi-passage unit of FIG. 4 (taken along line 10—10 thereof);

FIG. 10B is a plan view similar to FIG. 10A, associated with another embodiment of the invention;

FIG. 11 is a cross sectional view taken along line 11—11 of FIG. 10A;

DETAILED DESCRIPTION OF THE PREFERRED EMBODIMENTS

Figure 1:
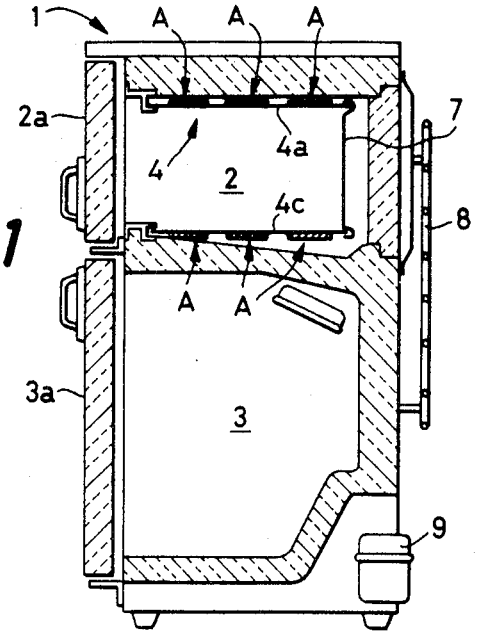
FIG. 1 is a cross sectional view of an embodiment of a freezing refrigerator with a box-like cooler defining a freezing chamber according to the invention.
Figure 2:
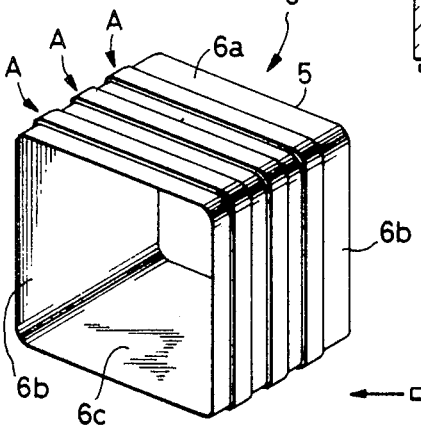
FIG. 2 is a perspective view of an evaporator which is an element of the box-like cooler of FIG. 1.

Referring first to FIG. 1 which illustrates in vertical elevation a freezing refrigerator including an evaporator according to this invention, numeral 1 designates a main body of the refrigerator wherein there are formed a freezing chamber 2 in the upper part thereof and a cold chamber 3 in the lower part. As well known in the art, the freezing and cold chambers 2 and 3 are provided at their open side with doors 2*a* and 3*a*, respectively, in order to provide an access to the respective chambers for storage and removal of foodstuff articles or other objects into and out of the chambers. The freezing chamber 2 is formed inside a freezing chamber cooler 4 having a substantially rectangular box-like structure. The cooler 4 for the freezing chamber 2 comprises a cooler body 6 of substantially rectangular box-like construction having a top wall portion 6*a*, side wall portions 6*b*, 6*b* and a bottom wall portion 6*c* as shown in FIG. 2, which cooler body is obtained by bending an aluminum sheet 5 to provide the above wall portions and provided with a back wall plate 7 as illustrated in FIG. 1. There are mounted on the other surfaces of the cooler body 6 three refrigerant flow passage assemblies A which are designed as an evaporator. Reference numerals 8 and 9 designate a condenser and a compressor, respectively, which are located at the back, and in a lower part of the back, of the refrigerator 1. The condenser 8, compressor 9 and flow passage assemblies A serve as major components of a cooling system for the refrigerator. In more detail, a refrigerant gas compressed by the compressor 9 is changed to a liquid or liquefied by the condenser 8, and the liquid refrigerant is changed to a vapor or vaporized while passing through the flow passage assemblies A (evaporator). Upon evaporation of the liquid refrigerant, heat is removed from the atmosphere surrounding the flow passage assemblies A whereby the articles or objects stored within the freezing and cold chambers 2, 3 are freezed or cooled. Upon leaving the evaporator or the flow passage assemblies A, the heat-laden vaporous refrigerant returns to the compressor 9 to repeat the refrigeration cycle.

Figure 3:
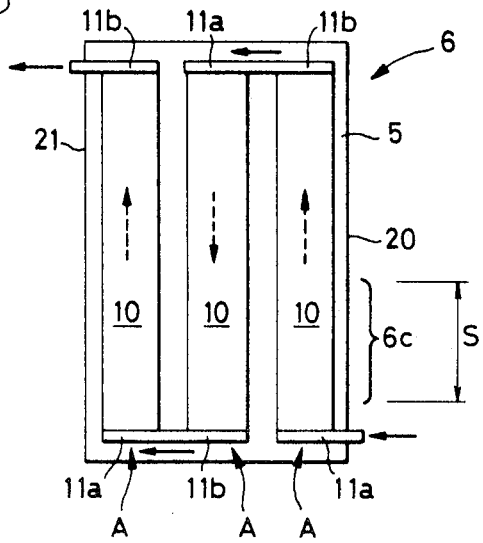
FIG. 3 is a plan view of the evaporator before its materials are bent into a box-like structure shown in FIG. 2.

As shown in FIG. 3 which is a plan view of the cooler body 6 before its materials are bent into the box-like structure illustrated in FIG. 2, the aluminum sheet 5 carries on one surface thereof, for example, three flow passage assemblies A which are fixed to the surface in a manner as later described. The sheet member 5 with the flow passage assemblies A fixed thereto is bent to form the wall portions of the cooler body 6 which has the rectangular cross section and defines the freezing chamber 2. The assemblies A are mounted on the outer surface of the sheet 5, i.e., on the surface not exposed to the freezing chamber 2 when the sheet is bent into the cooler body 6. The bottom wall 6*c* of the chamber 2 is formed, for example, of a segment S of the sheet 5 as indicated in FIG. 3.

Figure 4:
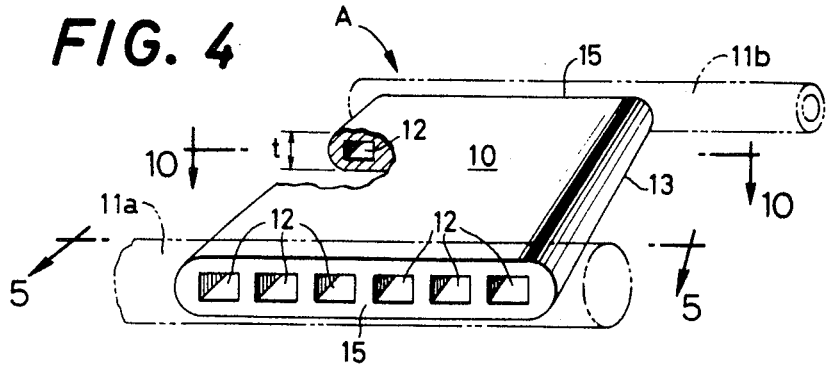
FIG. 4 is a schematic perspective view, partly cut away to show interior construction, of a refrigerant flow passage assembly according to the invention used in the evaporator of FIG. 3.
Figure 5:
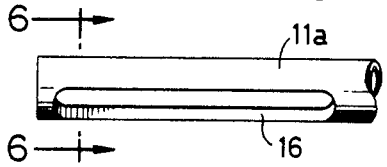
FIG. 5 is a schematic view taken along line 5—5 of FIG. 4.
Figure 6:
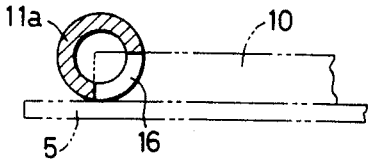
FIG. 6 is a fragmentary sectional view taken along line 6—6 of FIG. 5.
Figure 7:
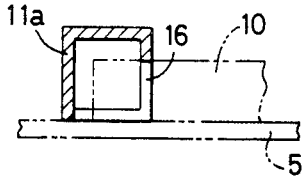
FIGS. 7, 8A, 8B and 9 are views similar to FIG. 6, associated with other embodiments of the invention, respectively.
Figure 8A:
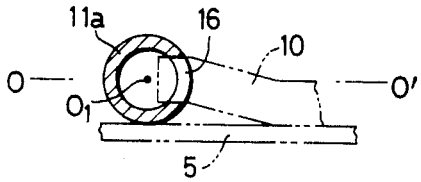
Figure 9:
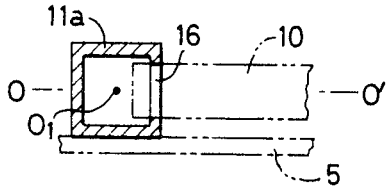
Figure 8B:
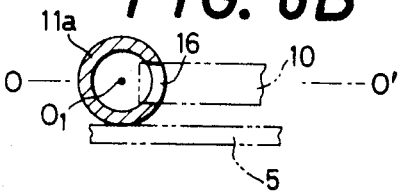

As illustrated in FIG. 4 which is a partly cut-away schematic perspective view, the refrigerant flow passage assemblies A each comprise a multi-passage unit 10 of plate-like configuration having a predetermined thickness, and a pair of header pipes 11*a* and 11*b*. The multi-passage unit 10 is for example an extrusion of aluminum materials having a plurality of refrigerant flow passages 12. The extruding process which is used to produce such multi-passage unit, is advantageous in that the hollow formations such as the passages 12 are comparatively readily obtained with rectangular, elliptical or any other cross sectional configurations desired. The passages 12 are formed or extend in parallel to one another along side edges 13 of the multi-passage unit 10, and are open at opposite end faces 15 of the same. The header pipes 11*a*, 11*b* are connected to the opposite ends of the unit 10, respectively, such that they extend substantially along the end faces 15 at which the passages 12 are open. The connection of the header pipes 11*a* and 11*b* to the unit 10 is more specifically explained by referring only to the inlet header pipe 11*a* because the similar explanation applies to the outer header pipe 11*b*. As seen in FIG. 5 which is a view taken along line 5—5 of FIG. 4, the header pipe 11*a* has a cutout or slot 16 axially formed through the wall thereof. The portion of the unit 10 adjacent the end face 15 fixedly engages the cutout 16 whereby the passages 12 are communicated with the interior of the header pipe 11*a*. When the header pipe 11*a* is made of plastics, it is fixed air-tightly to the unit 10 with an adhesive. When the pipe 11*a* is made of aluminum or other metallic materials, it is also air-tightly fixed to the unit 10 by soldering, brazing or similar means. As shown in FIG. 6 which is a fragmentary sectional view taken along line 6—6 of FIG. 5, the header pipe 11*a* is circumferentially oriented so that the unit 10 engaging the cutout 16 is put into abutment upon the surface of the sheet 5 over the entire area of the unit 10 or with substantially no air gap therebetween. The header pipe 11*a* which is usually tubular in cross section as the one shown in FIG. 6, may be rectangular as shown in FIG. 7. The cutout 16 of this rectangular header pipe 11*a* is formed in a portion of the wall adjacent to the surface of the sheet 5 so that the unit 10 engaging the cutout 16 is in abutment upon the same surface. It is possible of course that the cutout 16 is formed in a portion of the wall remote from the surface of the sheet 5 so that the center line O—O′ of the unit 10 is in alignment with the center $O_1$ of the header pipe 11*a*, as illustrated in FIGS. 8B and 9. In such instances, however, it is necessary to insert a lower mounting part of the header pipe 11*a* in a recess formed in the sheet 5 or interpose a metallic spacer strip between the surfaces of the pipe 11*a* and the sheet 5 so that these two members are kept in abutment upon each other, or necessary to bend the header pipe 11*a* so that it is in contact with the sheet 5 over the substantial length as shown in FIG. 8A.

As seen in FIG. 10A which presents a view taken along line 10—10 of FIG. 4, the inlet header pipe 11*a* is inclined at an angle $\theta$ with respect to the end face 15 of the multi-passage unit 10 so that a distance of extension of the end face 15 into the header pipe 11*a* increases in the direction of flow (to the right as viewed in FIG. 10A) of the refrigerant through the pipe 11*a*. Similarly, the outlet header pipe 11*b* is inclined at an angle $\theta$ with respect to the face 15 of the other end of the unit 10 so that a distance of extension of the end face 15 into the header pipe 11*b* decreases in the direction of refrigerant flow (to the right) through the pipe 11*b*. With this inclined relationship between the header pipes 11*a*, 11*b* and the multi-passage unit 10, all of the refrigerant flow passages 12 are open in a refrigerant supply (discharge) passage formed in the header pipe 11*a* (11*b*) in such manner that the open ends are spaced to one another as seen along the center line of the pipe 11*a* (11*b*) as shown in the cross sectional view of FIG. 11 taken along line 11—11 of FIG. 10A. Thus, the resistance of refrigerant flow through the supply or discharge passage of the header pipe 11*a* or 11*b* is balanced whereby the refrigerant evenly flows into, or discharge from, each refrigerant flow passage 12, i.e., a substantially equal amount of refrigerant is introduced from the inlet header pipe 11*a* into each flow passage 12 or discharged from each flow passage 12 into the outlet header pipe 11*b*. Accordingly, the inclined connection of the header pipes 11*a*, 11*b* to the unit 10 prevents otherwise possible stay of the refrigerant within any of the flow passages 12 and permits the unit 10 to effect a sufficient cooling over the entire area thereof. It is noted here that the angle $\theta$ of inclination is limited by inside diameters d of the header pipes 11*a*, 11*b*, thickness t of the multi-passage unit 10 (FIG. 4), overall width L of the unit 10, and other parameters, that is, the angle is determined mainly by the maximum allowable value of engagement of the unit 10 with the header pipes 11*a*, 11*b*. Actually, the inclination angle $\theta$ is set, for example, to within 8°. Experiments demonstrated that the refrigerant flowed evenly through all of the passages 12 when the angle $\theta$ was 4° where the inside diameter d=8 mm (outside diameter=10 mm, wall thickness=1 mm), thickness t=5 mm, and width L=100 mm. The inclination angle $\theta$ may be zero.

While the header pipes 11*a*, 11*b* are inclined with respect to the end face 15 of the multi-passage unit 10 as shown in FIG. 10A, it is alternatively possible that the header pipe 11*a* is connected to the unit 10 so that the axis thereof is normal to that of the passages 12 and that the unit 10 is formed with an end face 17 which is inclined to the axis of the header pipe 11*a* as shown in FIG. 10B such that the unit 10 extends radially of the pipe 11*a* an increasing distance in the direction of refrigerant flow through the refrigerant supply passage 18. This arrangement also establishes an angle $\theta$ of inclination between the header pipe 11*a* and the end face 17 of the unit. Although the above arrangement of relative inclination is associated with the end face 17 on the refrigerant inlet side of the unit 10, a similar arrangement may be introduced to the end face 15 on the outlet side of the unit 10 so as to allow the refrigerant to more evenly flow from each of the passages 12 into the refrigerant discharge passage 19.

The refrigerant flow passage assembly A thus constructed of the multi-passage unit 10 and the inlet and outlet header pipes 11*a* and 11*b*, is mounted on the sheet 5, preferably in plural numbers, as shown in FIGS. 3, and 12 through 15.

Referring back to FIG. 3, there are provided on the sheet 5 three flow passages assemblies A which are disposed in parallel to one another along the length of the sheet 5. The inlet header pipe 11*a* of the assembly A on the right-hand side of the sheet 5 as seen in FIG. 3, extends toward the right-hand side edge 20 and is connected to a refrigerant supply pipe not shown. The outlet header pipe 11*b* of the assembly A on the left-hand side of the sheet, extends toward the left-hand side edge 21 and is connected to a refrigerant discharge pipe not shown. The other inlet and outlet header pipes 11*a* and 11*b* are connected so as to connect the three flow passage assemblies A (multi-passage units 10) in series to one another such that the refrigerant flows through the flow passages 12 in alternately opposite directions from one unit 10 to the next, i.e., the direction of flow of the refrigerant through the flow passages 12 is alternately reversed at each junction of the adjacent assemblies A.

Figure 12:
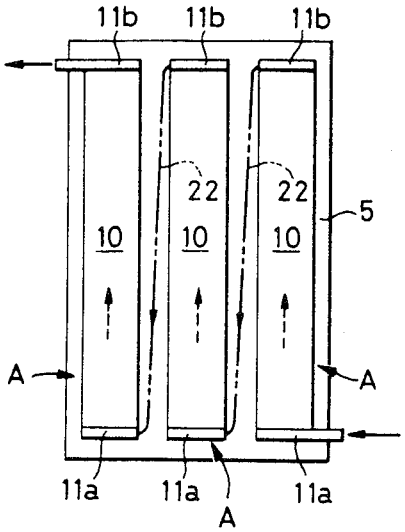
FIGS. 12 through 15 are views similar to FIG. 3, associated with other different embodiments of the invention, respectively.

The arrangement of FIG. 12 is substantially identical to that of FIG. 3 with an exception that the inlet header pipe 11*a* and the outlet header pipe 11*b* at the opposite ends of the adjacent flow passage assemblies A are connected to each other with connection pipes 22 disposed between the adjacent two multi-passage units 10. As a result, the three units 10 are connected in series such that the refrigerant flows in the same direction through the flow passages in all of the three units 10.

Figure 13:
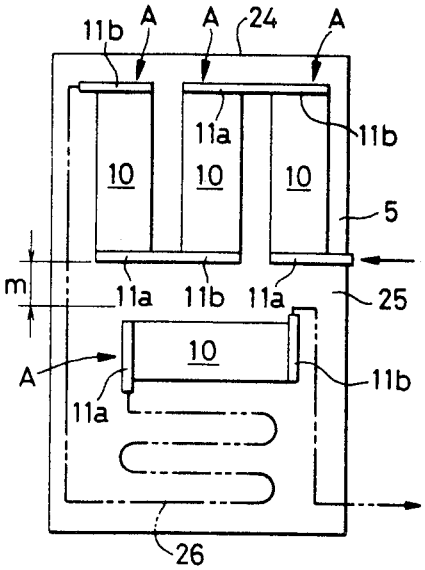
Figure 14:
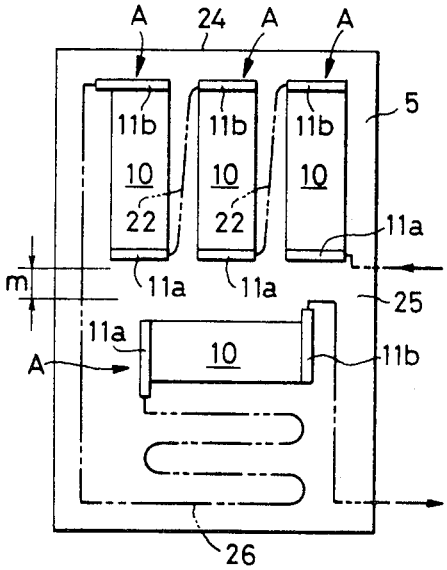

There are illustrated in FIGS. 13 and 14 other arrangements of the flow passage assemblies A, wherein the sheet 5 is divided into two sections by a boundary strip area 25 which is parallel to an end face 24 and whose width is indicated by character m. On one section of the sheet 5 (which is used to form, for example, the bottom wall portion 6*c* of the cooler shown in FIG. 2, or the like portion which acts as a primary cooling area), there are mounted three refrigerant flow passage assemblies A. On the other hand, one passage assembly A and a meandering pipe or coil 26 are disposed on the other section of the sheet 5. These four flow passage assemblies A and the pipe 26 are connected in series. The three assemblies A on said one section of the sheet 5 shown in FIG. 13 are connected to one another with the outlet and inlet header pipes 11*b* and 11*a* being directly connected to each other in the same manner as shown in FIG. 3. The three assemblies A on said one section of the sheet 5 shown in FIG. 14 are connected to one another with the outlet and inlet pipes 11*b* and 11*a* being connected via the connection pipes 22. The provision of such boundary stip area 25 as shown in FIGS. 13 and 14, and FIG. 15 referred to later, will facilitate a process of bending the sheet 5 with the passage assemblies A mounted thereon because the sheet 5 is bent at the area 25 without or with minimum bending of the assemblies A.

Figure 15:
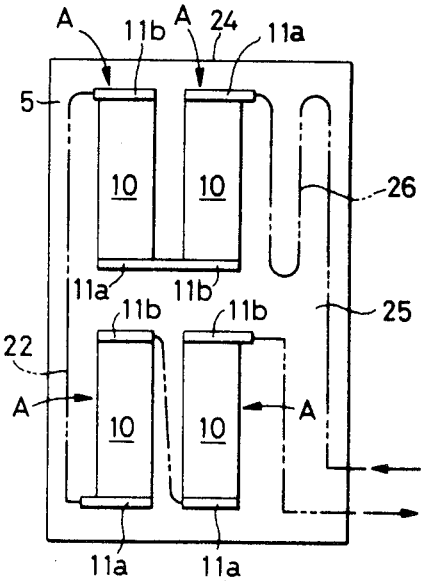
Figure 16:
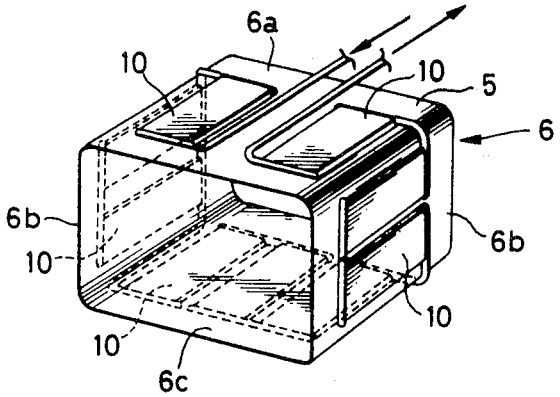
FIG. 16 is a view similar to FIG. 2, associated with another embodiment of the invention.

There are shown in FIG. 15 a pair of flow passage assemblies A on each of the sections of the sheet 5, that is, on both sides of the boundary strip area 25. In FIG. 16, there is illustrated an example of an evaporator serving as a cooler for a refrigerator which incorporates the technical features of the present invention shown in FIGS. 13–15. In more detail, this evaporator (6) is a combination of the aluminum sheet 5 bent to form a rectangular box-like structure, and a plurality of refrigerant flow passage assemblies A which are mounted on each outer wall surface of the rectangular box-like structure such that the multi-passage units 10 are disposed in parallel relation with one another. As shown in FIG. 16, these flow passage assemblies A are connected in series to one another but none of the multi-passage units 10 on one surface of the structure extend over the other surfaces. It is noted that the multi-passage units 10 on the side wall portions 6*b* are disposed so that the flow passages 12 are oriented in the horizontal direction.

It is understood here that like reference characters are used to designate like or corresponding parts or members throughout the several views in connection with the foregoing embodiments.

As described above, the multi-passage unit 10 of plate-like configuration according to the present invention is provided with the plurality of parallel refrigerant flow passages which enable the evaporator as a whole to have a high cooling capability, even in the event that a foodstuff article of room temperature is placed on a local or limited area 30 of the unit 10, that is, a large thermal load is applied to an area covering a few of the passages 12 and the refrigerant flowing through the passages subject to such thermal load is rapidly changed from a liquid to a vapor. In such case, the refrigerant entering the other passages 12 not associated with the limited area 30 will flow at a normal rate without being affected by the above thermal load and the pressure of vaporous refrigerant developed in the passages associated with the limited area 30, and will be discharged after the entire or majority portion thereof is vaporized absorbing heat from, and thus cooling, the atmosphere.

Since the refrigerant is prevented or restrained from being discharged in the form of a liquid from the evaporator of this invention, it is no longer necessary to provide a liquid accumulator as used in the art downstream of the evaporator outlet, and therefore possible to simplify the construction of the cooling or refrigerating system as a whole and reduce the cost of manufacture thereof. It is appreciated to dispose the refrigerant flow passage assembly A with the inlet and outlet header pipes 11*a* and 11*b* oriented substantially vertically, i.e., with the side edge 31 of the multi-passage unit 10 located below the other side edge 32 as viewed in FIG. 10A. With this orientation, the liquid refrigerant is accumulated in the passages 12 near the lower side edge 31 whereby such lower passages 12 may serve as an accumulator. In this respect as well, the present evaporator eliminates the need for an exclusive separate accumulator thereby lowering the cost of the system as a whole.

Figure 17:
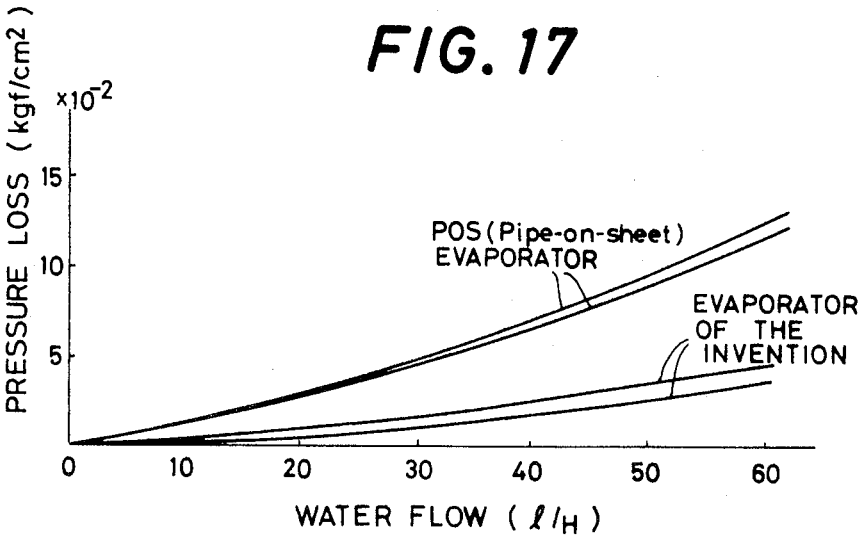
FIG. 17 is a graphical representation showing the pressure loss of the evaporator of the invention as compared with that of the conventional evaporators.

The provision of the multiplicity of parallel passages 12 within the unit 12 results in a considerable decrease in the overall flow resistance of the passage unit 10. This decreased flow resistance will make it possible to use a small-capacity compressor of low power consumption. The graph of FIG. 17 demonstrates the condition of flow of water in terms of pressure loss in relation to flow rate of the water introduced into the evaporator of the present invention as compared with the conventional pipe-on-sheet (POS) type of evaporators. As clearly seen from the graph, the pressure loss in the present evaporator is about one-third of that of the conventional evaporators.

According to the invention, a desired number of refrigerant flow passage assemblies A may be arranged on the sheet 5 to obtain a desired path pattern of flow passage. In other words, the same or substantially same assemblies A may be used to construct at a low cost a variety of evaporators having different flow passage patterns.

While the invention has been particularily shown and described with reference to preferred embodiments thereof, it will be understood by those skilled in the art that the foregoing and other changes in form and details can be made therein without departing from the spirit and scope of the invention.

For example, the cooler body 6 which, in the previously described embodiments, is the substantially rectangular box-like structure of bent aluminum sheet 5 having on its four outer surfaces the refrigerant flow passage assemblies A, may be adapted to have the assemblies A on at least one surface thereof, and preferably on more than two surfaces, and may have the back plate 7 which also have at least one passage assembly A if so required.

As another example, the cooler 4 which is of box-like configuration in the previous embodiments, may be a flat sheet or a sheet bent to L-letter shape having a single or two surfaces, respectively, on which the passage assemblies A are mounted. It is also possible to mount the passage assembles A on a plate or plates which constitute a freezing chamber cooler as disclosed in U.S. Pat. No. 4,270,369, the disclosure of which is hereby incorporated by reference.

What is claimed is:

1. An evaporator comprising:

at least one multi-passage unit of plate-like configuration constructed of a thermally conductive material, said multi-passage unit having a plurality of partition walls to define a plurality of refrigerant flow passages in parallel with one another, and further having substantially the same thickness over the entire width area in which said flow passages are defined along a length of said multi-passage unit, said flow passages being spaced from one another only by respective ones of said partition walls and open at opposite ends of said multi-passage unit;

inlet header means for distributing refrigerant into said plurality of refrigerant flow passages, said inlet header means being connected to one of said opposite ends of the multi-passage unit and having a refrigerant supply passage through which the refrigerant is supplied and to which said flow passages are open at said one end, said header means having a cutout axially formed through the wall thereof to communicate with said refrigerant supply passage, said one end of the multi-passage unit fixedly engaging said cutout so that a distance of extension thereof radially of said inlet header means into said refrigerant supply passage increases in the direction of flow of the refrigerant therethrough;

outlet header means for collecting and discharging the refrigerant flowing out of said flow passages, said outlet header means being connected to the other end of said multi-passage unit and having a refrigerant discharge passage through which the refrigerant is discharged and to which said flow passages are open at said other end; and a sheet member made of a thermally conductive material to which said multi-passage unit is fixed with one surface thereof being in abutment on one surface of said sheet member with substantially no air gap therebetween.

2. An evaporator comprising:

at least one multi-passage unit of plate-like configuration constructed of a thermally conductive material, said multi-passage unit having a plurality of partition walls to define a plurality of refrigerant flow passages in parallel with one another, and further having substantially the same thickness over the entire width area in which said flow passages are defined along a length of said multi-passage unit, said flow passages being spaced from one another only by respective ones of said partition walls and open at opposite ends of said multi-passage unit;

inlet header means for distributing refrigerant into said plurality of refrigerant flow passages, said inlet header means being connected to one of said opposite ends of the multi-passage unit and having a refrigerant supply passage through which the refrigerant is supplied and to which said flow passages are open at said one end;

outlet header means for collecting and discharging the refrigerant flowing out of said flow passages, said outlet header means being connected to the other end of said multi-passage unit and having a refrigerant discharge passage through which the refrigerant is discharged and to which said flow passage are open at said other end, said outlet header means having a cutout axially formed through the wall thereof to communicate with said refrigerant discharge passage, said other end of the multi-passage unit fixedly engaging said cutout so that a distance of extension thereof radially of said outlet header means into said refrigerant discharge passage decreases in the direction of flow of the refrigerant therethrough; and a sheet member made of a thermally conductive material to which said multi-passage unit is fixed with one surface thereof being in abutment on one surface of said sheet member with substantially no air gap therebetween.

3. An evaporator as recited in any one of claims 1 or 2, wherein said multi-passage unit is an extrusion made of either one of aluminum and aluminum alloy materials having hollow sections to form said plurality of refrigerant flow passages.

4. A cooler having a freezing chamber, which comprises:

a sheet member constructed of a thermally conductive material and bent to form wall portions of a substantially rectangular box structure to define said freezing chamber;

at least one multi-passage unit of plate-like configuration constructed of a thermally conductive material, said multi-passage unit including a plurality of partition walls to define a plurality of refrigerant flow passages in parallel relation with one another, and further having substantially the same thickness over the width in which said flow passages are defined along a length of said multi-passage unit, said flow passages being spaced from one another only by respective ones of said partition walls and open at opposite ends of said multi-passage unit;

inlet header means for distributing refrigerant into said plurality of refrigerant flow passages, said inlet header means being connected to one of said opposite ends of the multi-passage unit and having a refrigerant supply passage through which the refrigerant is supplied and to which said flow passages are open at said one end; and outlet header means for collecting and discharging the refrigerant flowing out of said flow passages, said outlet header means being connected to the other end of said multi-passage unit and having a refrigerant discharge passage through which the refrigerant is discharged and to which said flow passages are open at said other end, each of at least two of said wall portions of the rectangular box structure carrying on its outer surface at least one flow passage assembly each consisting of said multi-passage unit and said inlet and outlet header means, the flow passage assemblies on said at least two wall portions being connected in series to one another, each of the multi-passage units on said at least two wall portions being fixed to said rectangular box structure such that one surface of the multi-passage unit is in abutment on said outer surface of only the respective one of said wall portions, whereby no part of the multi-passage unit of said at least one flow passage assembly is bent to lie on two or more of said wall portions.

5. A cooler as recited in claim 4, wherein at least one of the side, top and bottom wall portions of said rectangular box structure carries on the outer surface thereof said at least one flow passage assembly.

6. A cooler as recited in claim 4, wherein at least one of the side wall portions of said rectangular box structure carries on the outer surface thereof at least one refrigerant flow passage assembly consisting of said multi-passage unit and said inlet and outlet header means, said at least one flow passage assembly being disposed such that the plurality of refrigerant flow passages in said multi-passage unit extend in substantially horizontal direction.

7. A cooler as recited in claim 4, wherein said inlet header means has a cutout axially formed through the wall thereof to communicate with said refrigerant supply passage, and said one end of the multi-passage unit fixedly engages said cutout so that a distance of extension thereof radially of said inlet header means into said refrigerant supply passage increases in the direction of flow of the refrigerant therethrough.

8. A cooler as recited in claim 4, wherein said outlet header means has a cutout axially formed through the wall thereof to communicate with said refrigerant discharge passage, and said other end of the multi-passage unit fixedly engages said cutout so that a distance of extension thereof radially of said outlet header means into said refrigerant discharge passage decreases in the direction of flow of the refrigerant therethrough.

9. A refrigerator comprising a cooler having a freezing chamber, said cooler comprising:

a sheet member constructed of a thermally conductive material and bent to form wall portions of a substantially rectangular box structure to define said freezing chamber;

at least one multi-passage unit of plate-like configuration constructed of a thermally conductive material, said multi-passage unit including a plurality of partition walls to define a plurality of refrigerant flow passages in parallel relation with one another, and further having substantially the same thickness over the entire width in which said flow passages are defined along a length of said multi-passage unit, said flow passages being spaced from one another only by respective ones of said partition walls and open at opposite ends of said multi-passage unit;

inlet header means for distributing refrigerant into said plurality of refrigerant flow passages, said inlet header means being connected to one of said opposite ends of the multi-passage unit and having a refrigerant supply passage through which the refrigerant is supplied and to which said flow passages are open at said one end; and outlet header means for collecting and discharging the refrigerant flowing out of said flow passages, said outlet header means being connected to the other end of said multi-passage unit and having a refrigerant discharge passage through which the refrigerant is discharged and to which said flow passages are open at said other end, each of at least two of said wall portions of the rectangular box structure carrying on its outer surface at least one flow passage assembly each consisting of said multi-passage unit and said inlet and outlet header means, the flow passage assemblies on said at least two wall portions being connected in series to one another, each of the multi-passage units on said at least two wall portions being fixed to said rectangular box structure such that one surface of the multi-passage unit is in abutment on said outer surface of only the respective one of said wall portions, whereby no part of the multi-passage unit of said at least one flow passage assembly is bent to lie on two or more of said wall portions.

* * * * *